US012281602B2

(12) United States Patent
Anjaneyulu et al.

(10) Patent No.: US 12,281,602 B2
(45) Date of Patent: Apr. 22, 2025

(54) VALVETRAIN SPACER

(71) Applicant: Caterpillar Inc., Peoria, IL (US)

(72) Inventors: Ram Prasanth Anjaneyulu, Chennai (IN); Mike Dean Roley, Washington, IL (US); Paul Jon Schweiger, Dunlap, IL (US); Quinton Burcar, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/200,905

(22) Filed: May 23, 2023

(65) Prior Publication Data

US 2024/0392707 A1 Nov. 28, 2024

(51) Int. Cl.
*F01L 3/08* (2006.01)
*F01L 1/18* (2006.01)

(52) U.S. Cl.
CPC ..... *F01L 3/08* (2013.01); *F01L 1/181* (2013.01); *F01L 2810/02* (2013.01)

(58) Field of Classification Search
CPC ..... F01L 1/46; F01L 1/181; F01L 3/08; F01L 2810/02; F01M 9/10; F01M 9/107
See application file for complete search history.

(56) References Cited

U.S. PATENT DOCUMENTS

| | | | | |
|---|---|---|---|---|
| 6,460,502 | B2 * | 10/2002 | Gracyalny | F02F 1/24 123/193.5 |
| 7,530,338 | B2 | 5/2009 | Falkowski et al. | |
| 7,757,647 | B2 | 7/2010 | Tanabe et al. | |
| 11,242,774 | B2 | 2/2022 | Hattiangadi et al. | |
| 2006/0272598 | A1 * | 12/2006 | Wakeman | F01L 1/143 123/21 |
| 2009/0020087 | A1 * | 1/2009 | Tanabe | F01L 13/0005 123/90.39 |
| 2009/0301418 | A1 * | 12/2009 | Arinaga | F01L 13/0021 123/90.34 |
| 2013/0112171 | A1 * | 5/2013 | Matsukawa | F02M 43/00 123/456 |
| 2022/0154605 | A1 * | 5/2022 | Burge | F01L 3/10 |

FOREIGN PATENT DOCUMENTS

| | | | | |
|---|---|---|---|---|
| CN | 204646351 | U | 9/2015 | |
| CN | 208473945 | U | 2/2019 | |
| CN | 208686443 | U | 4/2019 | |
| CN | 210239770 | U | 4/2020 | |
| CN | 214741526 | U | 11/2021 | |
| GB | 2349181 | A * | 10/2000 | F01L 1/18 |
| KR | 19980045603 | U | 9/1998 | |
| WO | 2022242850 | A1 | 11/2022 | |

* cited by examiner

*Primary Examiner* — Grant Moubry

(57) ABSTRACT

A spacer for an engine is disclosed. The spacer comprises a hollow body having an inner surface, a pathway formed along a perimeter on the inner surface, an adapter disposed on the pathway, and a slot formed through the hollow body on the pathway.

16 Claims, 7 Drawing Sheets

VALVETRAIN SPACER

TECHNICAL FIELD

The present disclosure generally relates to internal combustion engines, and more particularly relates to valvetrain components associated with internal combustion engines.

BACKGROUND

An internal combustion engine is a type of heat engine that uses the combustion of fuel to generate power, and it can be classified into various types such as gasoline, diesel, or rotary engines. A valvetrain is a mechanical system in an internal combustion engine that controls the operation of the intake and exhaust valves in an internal combustion engine. The intake valves control the flow of air/fuel mixture into the combustion chamber, while the exhaust valves control the flow of spent exhaust gasses out of the combustion chamber once combustion is completed. A rocker arm is a valvetrain component that typically transfers the motion of a pushrod to the corresponding intake/exhaust valve. The rocker arms rotate to press downwards on the top of the valves, which opens the valve by moving it downwards.

Stem seals control the lubrication of the valve stem as it slides in the valve guide. Too little oil causes valve stem wear. Too much oil increases oil consumption and can cause a buildup of debris, leading to valve seal damage and an early valve life. Faulty valve stem seals also increase oil consumption and reduced performance of the engine. Insufficient oil lubrication to the stem seal causes reduced heat dissipation resulting in dry run environments that create high valve stem wear requiring repair or replacement.

Others have attempted to provide solutions for lubricating valve stems, but fail to supply enough oil to the stem seals to eradicate dry run environments on the valve stems. For example, CN210239770 discloses an engine valve mechanism having a rocker arm assembly that utilizes oil drainage grooves integrated on one rocker thrust ring so that untimely oil drainage and the reliability of the rocker bushing is improved. The reference fails to disclose how to lubricate the stem seals of the valve stems that coupled to the rocker arm assembly.

It can therefore be seen that a need exists for a valvetrain system that supplies sufficient oil to the stem seals to avoid dry run environments and improve heat dissipation from the valve stems.

SUMMARY OF THE DISCLOSURE

In accordance with one aspect of the disclosure, a spacer for a valvetrain system is disclosed. The spacer comprises: a hollow body having an inner surface, a pathway formed along a perimeter on the inner surface, an adapter disposed on the pathway, and a slot formed through the hollow body on the pathway.

In accordance with another aspect of the disclosure, an engine is disclosed. The engine comprises: a plurality of valve stems, a rocker shaft having a primary fluid channel, a plurality of rocker arms rotatably fixed on the rocker shaft and coupled to the plurality of valve stems, and a plurality of spacers disposed on the rocker shaft between each rocker arms. Each spacer has a hollow body having an inner surface, a pathway formed along a perimeter on the inner surface, an adapter disposed on the pathway and configured to fluidly connect the primary fluid channel and the pathway; and a slot formed through the hollow body along the pathway.

In accordance with another aspect of the disclosure, a method of lubricating a valve stem coupled to a rocker manifold in a valvetrain system of an engine. The method comprises: providing a spacer on the rocker shaft having a primary fluid channel, the spacer including a hollow body having an inner surface, a pathway formed along a perimeter on the inner surface, an adapter disposed on the pathway, and a slot formed through the hollow body on the pathway, wherein the adapter fluidly connects the primary fluid channel to the pathway; operating the valvetrain system; transferring fluid from the primary fluid channel to exit the slot via the adapter and pathway; and lubricating the valve stem with the fluid.

These and other aspects and features of the present disclosure will be better understood upon reading the following detailed description when read in conjunction with the accompanying drawings.

Figure 1:
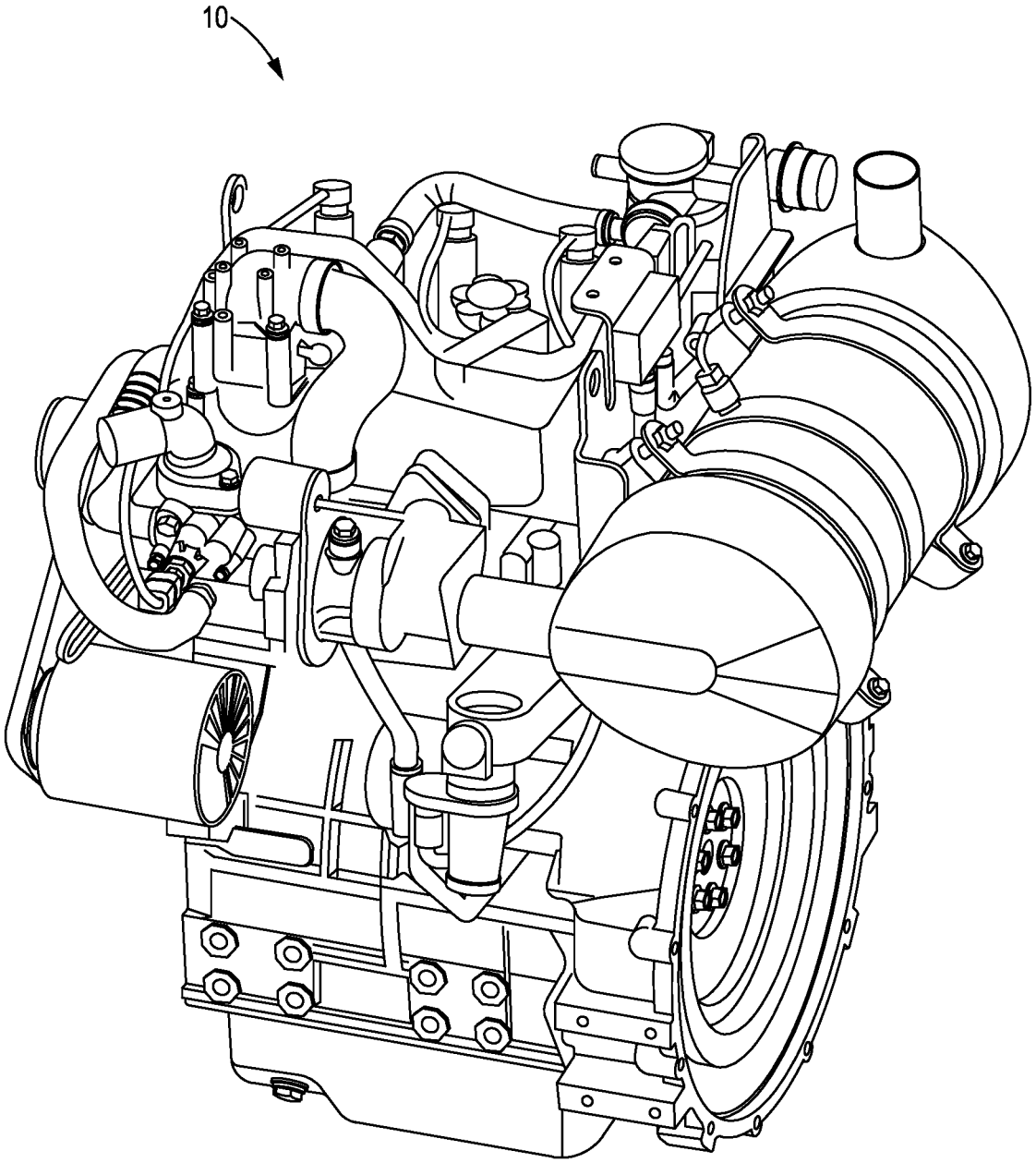
FIG. 1 is a perspective view of an engine, according to one embodiment of the disclosure.

The figures depict one embodiment of the presented invention for purposes of illustration only. One skilled in the art will readily recognize from the following discussion that alternative embodiments of the structures and methods illustrated herein may be employed without departing from the principles described herein.

DETAILED DESCRIPTION

Referring now to the drawings, and with specific reference to the depicted example, an engine 10 is shown, illustrated in an exemplary combustion engine. Combustion engines are primary movers of work machines and vehicles such as excavators, cars, trucks, and the like. While the following detailed description describes an exemplary aspect in connection with the combustion engine, it should be appreciated that the description applies equally to the use of the present disclosure in other engines including but not limited to rotary engines, gasoline combustion engines, and/or diesel engines employed in various work machines and generators.

Figure 2:
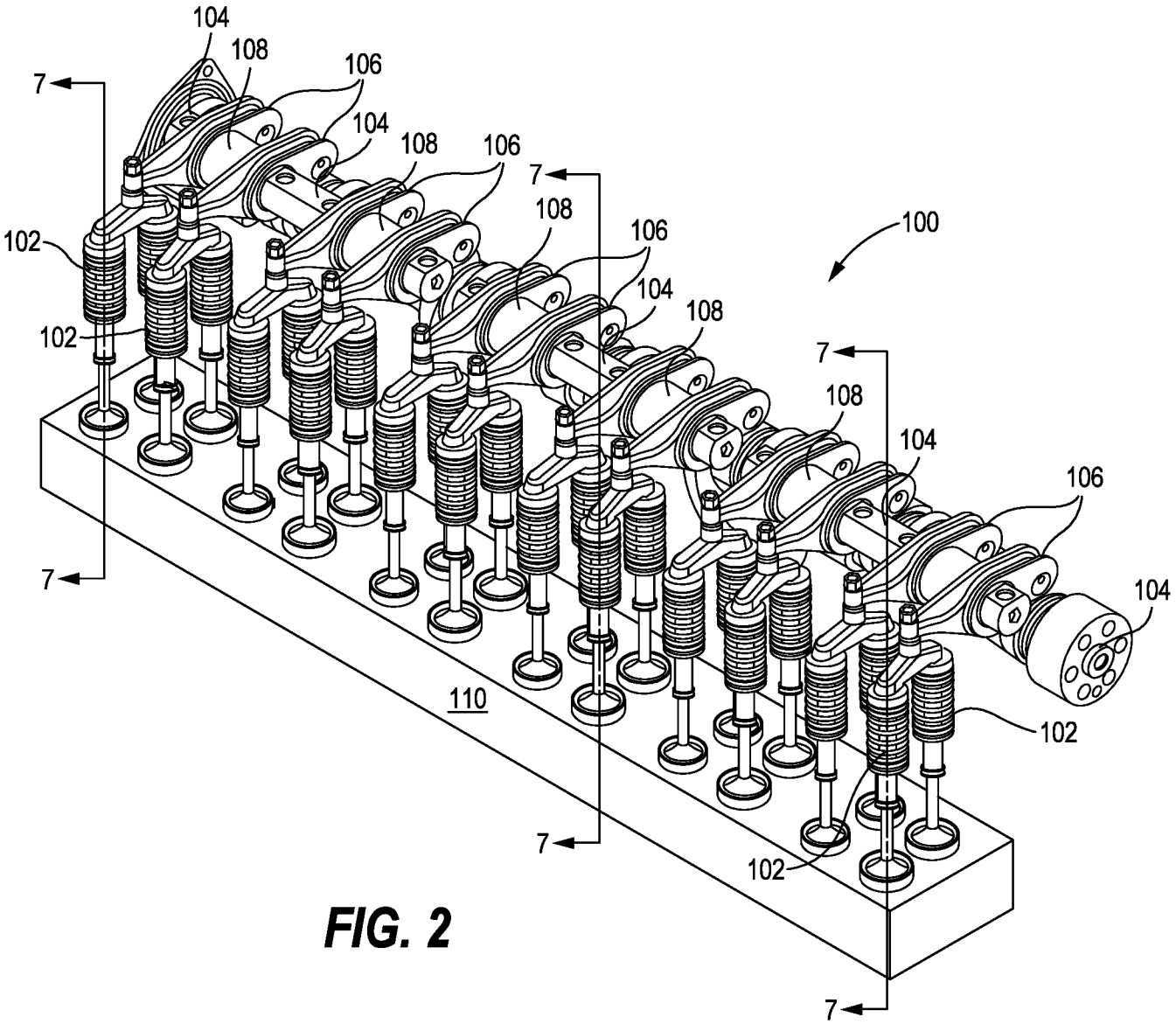
FIG. 2 is a perspective view of a valvetrain system, according to one embodiment of the disclosure.

Referring now to FIG. 2, a valvetrain system 100 in the engine 10 is illustrated, according to one embodiment of the disclosure. The valvetrain system 100 comprises a plurality of valve stems 102, a rocker shaft 104, a plurality of rocker arms 106 rotatably fixed on the rocker shaft 104, an at least one spacer 108, and a combustion box 110. The plurality of valve stems 102 are coupled to the plurality of rocker arms 106. The plurality of rocker arms 106 are spaced apart on the rocker shaft 104. Between each of the plurality of rocker arms 106 are an at least one spacer 108. The combustion box 110 may be an internal combustion engine.

Figure 3:
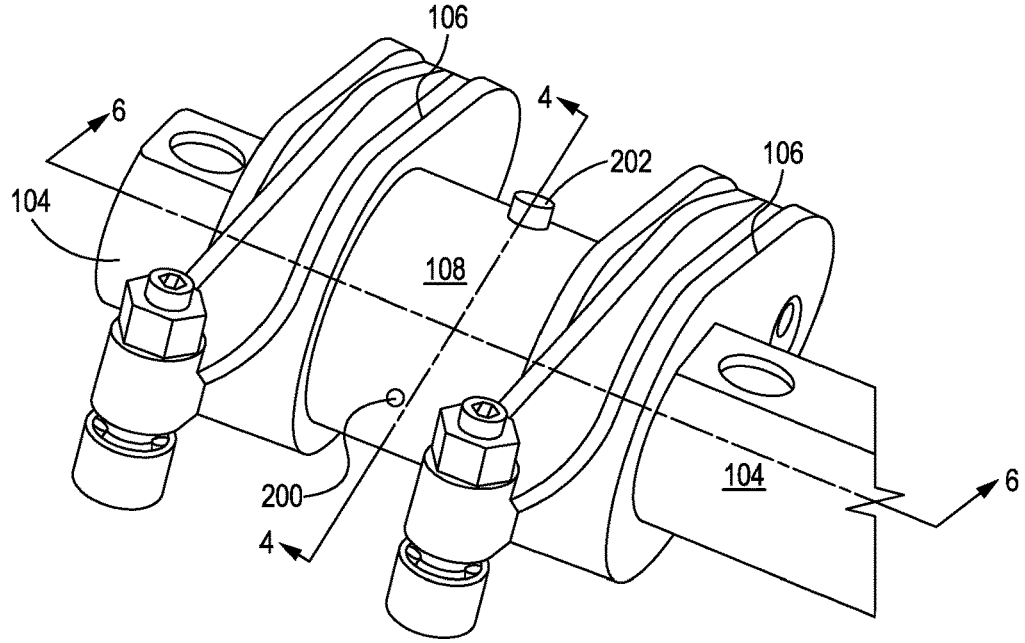
FIG. 3 is a perspective view of rocker assembly of the valvetrain system of FIG. 1, according to one embodiment of the disclosure.

Referring now to FIG. 3, a portion of the valvetrain system 100 is illustrated, according to one embodiment of the disclosure. The portion illustrated in FIG. 3 may be a portion of a rocker manifold, as generally known in the arts, having the rocker shaft 104, and the plurality of rocker arms 106. The at least one spacer 108 is provided around the rocker shaft 104 as the at least one spacer 108 may have a hollow body such as a hollow cylindrical body or a square hollow body, as generally known in the arts. The at least one spacer 108 may include an at least one slot 200, which may be a hole provided through the body of the at least one spacer 108. The at least one spacer 108 may have a diameter of 1 mm or larger. The at least one slot 200 may provide a fluid connection with the rocker shaft 104.

The at least one spacer 108 may also include a fastener 202 which may be a screw, bolt, or the like. The fastener 202 may be disposed in and extend through a second slot 204 provided on the hollow body of the at least one spacer 108. The fastener 202 helps constrain angular movement of the at least one spacer 108 during operation of the valvetrain system 100.

Figure 4:
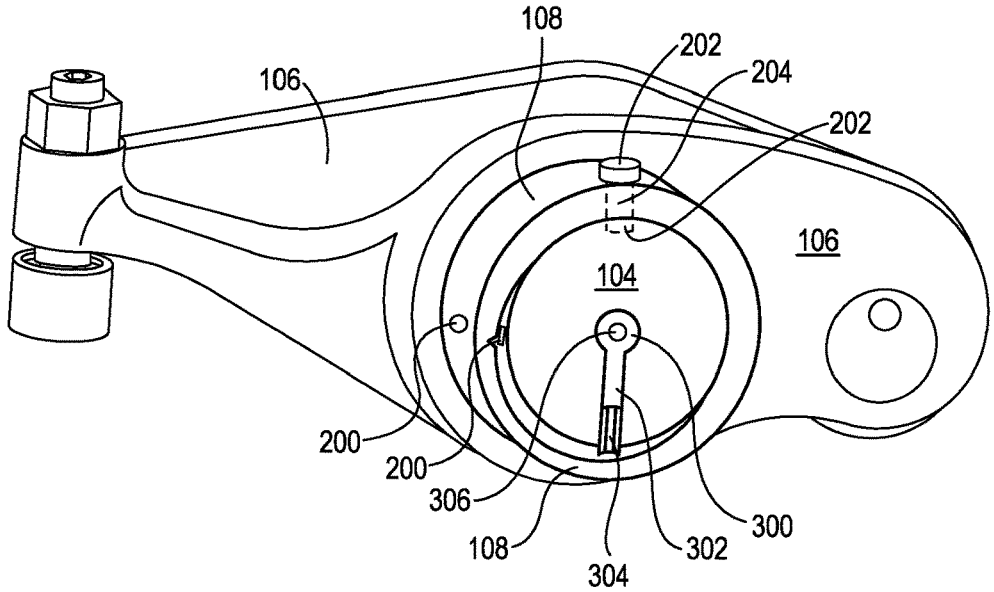
FIG. 4 is a cross-section of the rocker assembly of FIG. 2 taken along line 4-4, according to one embodiment of the disclosure.

Referring now to FIG. 4, a cross section of the rocker shaft 104 of FIG. 3 taken along line 4-4 is illustrated, according to one embodiment of the disclosure. The rocker shaft 104 includes a primary fluid channel 300 and a secondary fluid channel 302. The at least one spacer 108 may be provided with an adapter 304 that connects to the primary fluid channel 300 or the secondary fluid channel 302 of the rocker shaft 104. The primary fluid channel 300 and the secondary fluid channel 302 may contain a fluid such as oil, air, or other fluid or gas, as generally known in the arts. The at least one slot 200 may provide a fluid connection with the rocker shaft 104. The at least one slot 200 may be provided at an angle and provided as a hole, or the like. The at least one slot 200 may be provided at an angle to allow a fluid to exit in a certain direction and may be at least 1 mm in diameter. The fastener 202 helps constrain angular movement of the at least one spacer 108 during operation of the valvetrain system 100 and may be provided through the at least one spacer 108. The fastener 202 may contact the rocker shaft 104 to prevent angular movement of the at least one spacer 108. There may be a ball bearing 306 provided in the primary fluid channel 300 or secondary fluid channel 302 to support fluid flow in the rocker shaft 104, as generally known in the arts.

Figure 5:
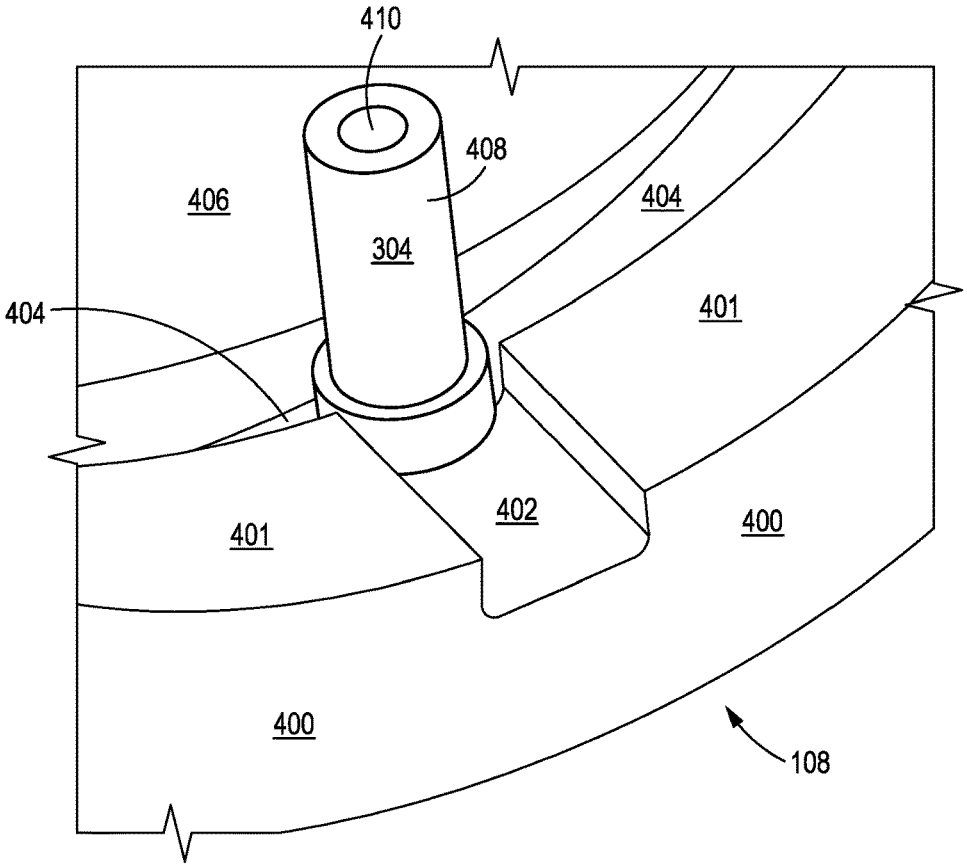
FIG. 5 is a perspective view of a portion of a spacer, according to one embodiment of the disclosure.

Referring now to FIG. 5, a portion of the at least one spacer 108 is illustrated, according to an embodiment of the disclosure. The at least one spacer 108 has a hollow body 400 that includes an inner surface 401, as well as an adapter pathway 402 and a fluid pathway 404 both provided on the inner surface 401. The hollow body 400 may be cylindrical or rectangular. The adapter pathway 402 may be provided longitudinally along the inner surface 401 which may provide access for installing the adapter 304 into the at least one spacer 108 and positioned within the fluid pathway 404. The adapter 304 extends into a hollow center 406 of the hollow body 400 of the at least one spacer 108. The adapter 304 may have an adapter body 408 that is elongated and extends into the hollow center 406. The adapter body 408 may further include an adapter fluid channel 410 which may be used for fluid transfer oils and gases, as generally known in the arts. The fluid pathway 404 may be circumferentially provided along the inner surface 401 of the at least one spacer 108.

Figure 6:
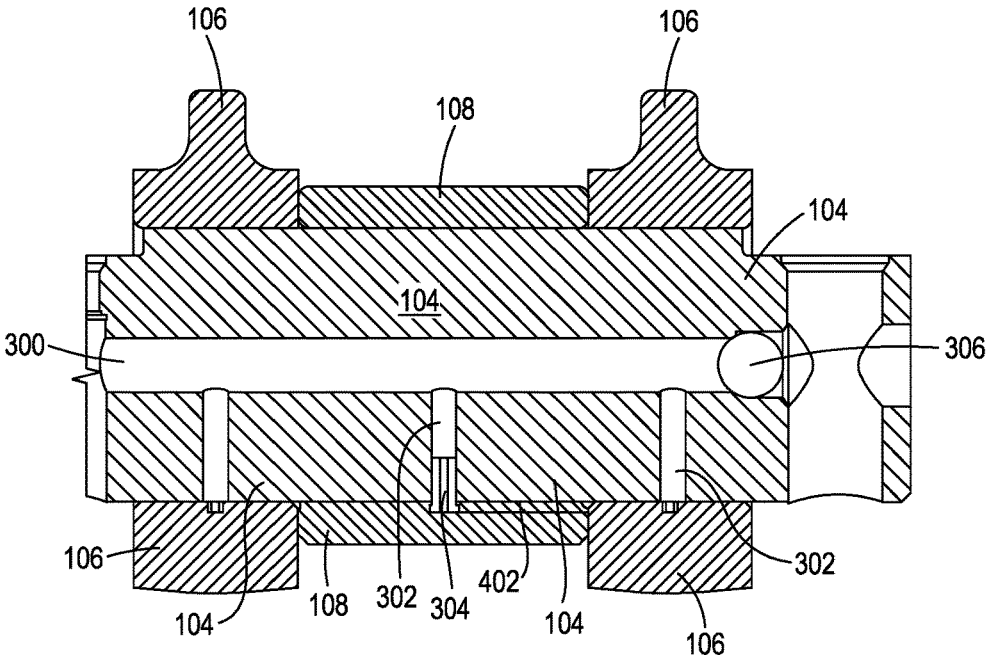
FIG. 6 is a cross-section of the rocker assembly of FIG. 2 taken along line 6-6, according to another embodiment of the disclosure

Referring now to FIG. 6, a cross-section of the rocker shaft 104 of FIG. 3 taken along line 6-6, according to one embodiment of the disclosure. The primary fluid channel 300 may extends along the longitudinal length of the rocker shaft 104. The ball bearing 306 may be provided in the primary fluid channel 300 which helps facilitate oil or other fluid to flow through the secondary fluid channel 302 and into the fluid pathway of the spacer 108, as generally known in the arts. The spacer 108 is coupled around the rocker shaft 104 which may be cylindrical or rectangular, or the like.

Figure 7:
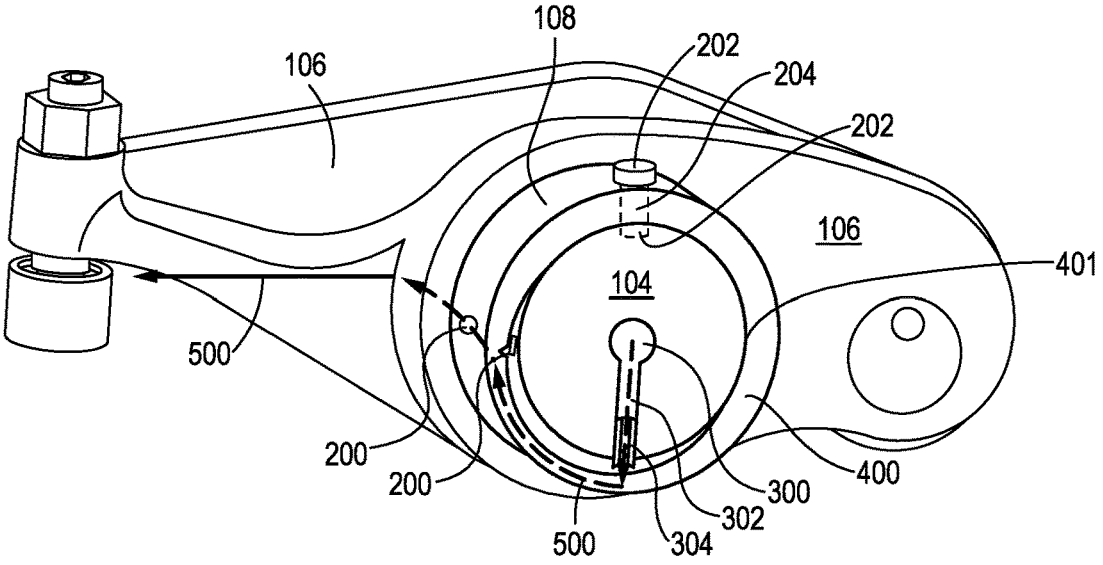
FIG. 7 is a cross-section of the rocker assembly of FIG. 2 taken along line 4-4, according to another embodiment of the disclosure.

Referring now to FIG. 7, a cross-section of the rocker shaft 104 of FIG. 2 taken along line 4-4 demonstrating fluid flow is illustrated, according to one embodiment of the disclosure. The adapter 304 is fluidly connected to the primary fluid channel 300 and the secondary fluid channel 302 so that a fluid, such as oil, may transfer from the rocker shaft 104 to the fluid pathway 404 and along a fluid exit path 500 to the at least one slot 200 whereby the fluid exits the at least one spacer 108. The pressure in the rocker shaft 104 or valvetrain system 100 may cause the fluid to move along the fluid pathway 404 and follow the fluid exit path 500 so that the fluid exits the at least one slot 200. The fluid, which may be an oil, will then fall or drip onto and lubricate the plurality of valve stems 102.

When the fluid moves along the fluid pathway 404, a tendency of angular movement of the at least one spacer 108 occurs. The slot 402 and adapter 304 may also prevent rotational movement of spacer 400 and lock it such that the oil stream strikes one of the plurality of rocker arms 106 at a desired point to supply enough oil to at least one of the plurality of valve stems 102. This rotational movement of the spacer 400 can also be arrested by providing the fastener 202 to also help constrain angular movement of the at least one spacer 108 during operation of the valvetrain system 100, so that the at least one slot 200 may effectively remain in the same position so oil may exit the spacer 108 along the fluid exit path 500 and continue to drip in the same location.

Figure 8:
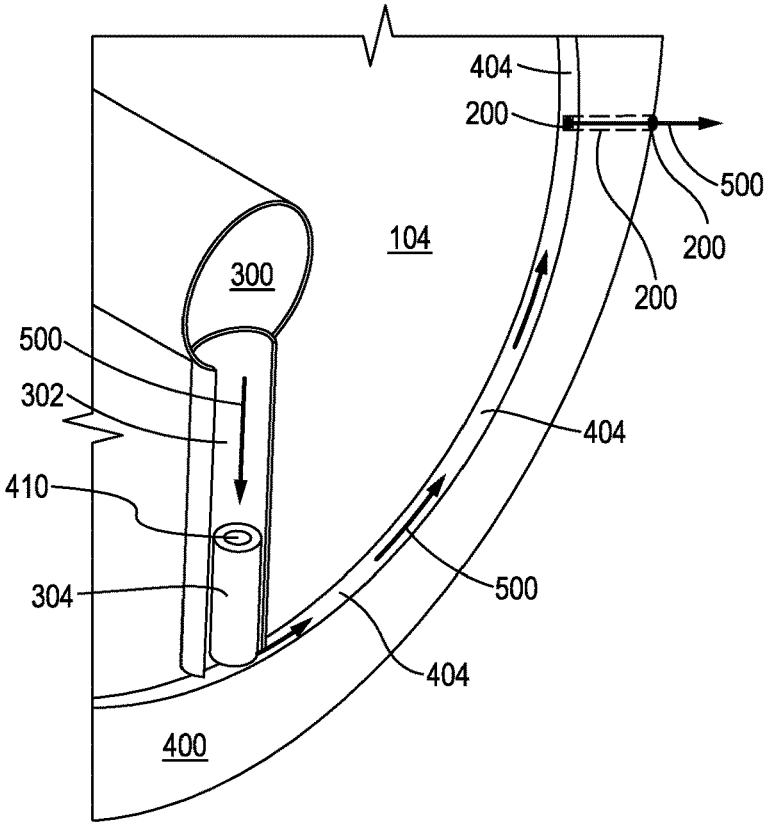
FIG. 8 is a perspective view of a portion of the spacer of FIG. 4, according to one embodiment of the disclosure.

Referring now to FIG. 8, a portion of the at least one spacer 108 is illustrated around the rocker shaft 104, according to one embodiment of the disclosure. The pressure in the rocker shaft 104 or valvetrain system 100 so that a fluid, such as oil, may transfer from the primary fluid channel 300 of the rocker shaft 104, through the secondary fluid channel 302, through the adapter fluid channel 410, to the fluid pathway 404 and along a fluid exit path 500. Pressure may cause the fluid build-up resulting in the fluid moving along the fluid pathway 404 and following the fluid exit path 500 so that the fluid exits the at least one slot 200 and exit the at least one spacer 108. The fluid, which may be an oil, will fall or drip onto and lubricate the plurality of valve stems 102.

Figure 9:
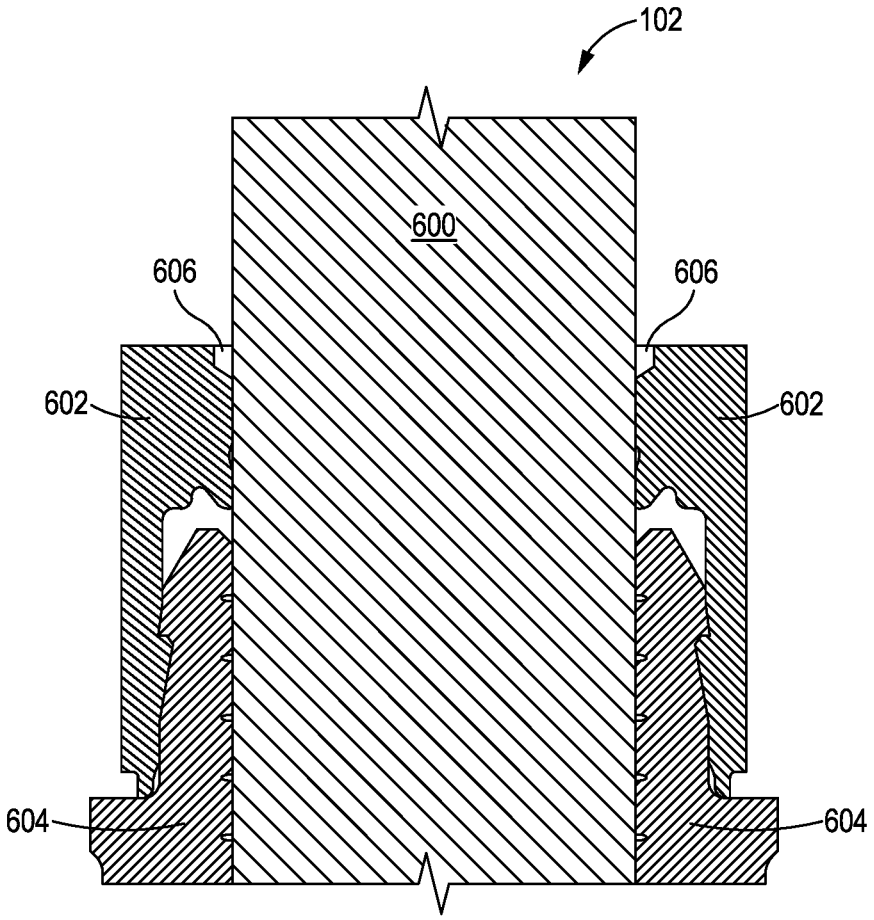
FIG. 9 is a cross-section of a valve stem, according to one embodiment of the disclosure.

Referring now to FIG. 9, a cross section of one of the plurality of valve stems 102 is illustrated, according to one embodiment of the disclosure. The plurality of valve stems 102 each include a valve guide 600, a stem seal 602, a valve spring 604, and a lubrication area 606. As the fluid follows the fluid exit path 500 from the primary fluid channel 300 of the rocker shaft 104 and out the at least one slot 200, the fluid then falls onto the plurality of valve stems 102 by gravity and/or operation of the valvetrain system 100 or environment in which the valvetrain system 100 is incorporated. The fluid will untimely fall or drip into the lubrication area 606, which will then provide lubrication to the stem seal 602 as the valve guide 600 frictionally actuates against the stem seal 602 during operation of the valvetrain system 100. The lubrication provided to the stem seal 602 by the fluid exiting the at least one slot 200 extends the life of the stem seal 602 and reduces the time and expense of replacing new stem seals. The stem seal 602 may be made from a variety of materials, including nylon, PTFE rubber, steel, and synthetic rubber. Directing oil to the lubrication area 606 provides enough oil to the stem seal 602 to avoid dry run environments while also improving heat dissipation from the plurality of valve stems 102.

INDUSTRIAL APPLICABILITY

In operation, the present disclosure may find applicability in many industries including, but not limited to, the automotive, construction, earth-moving, mining, and agricultural industries. Specifically, the technology of the present disclosure may be used for prime mover systems of work machines including, but not limited to, engines, motors, and the like. While the foregoing detailed description is made with specific reference to combustion engines for work machines, it is to be understood that its teachings may also be applied onto the other engines such as rotary engines, gasoline engines, diesel engines, and the like for automobiles, trucks, planes, off-road vehicles, ATVs, and other machines having combustion engines.

Figure 10:
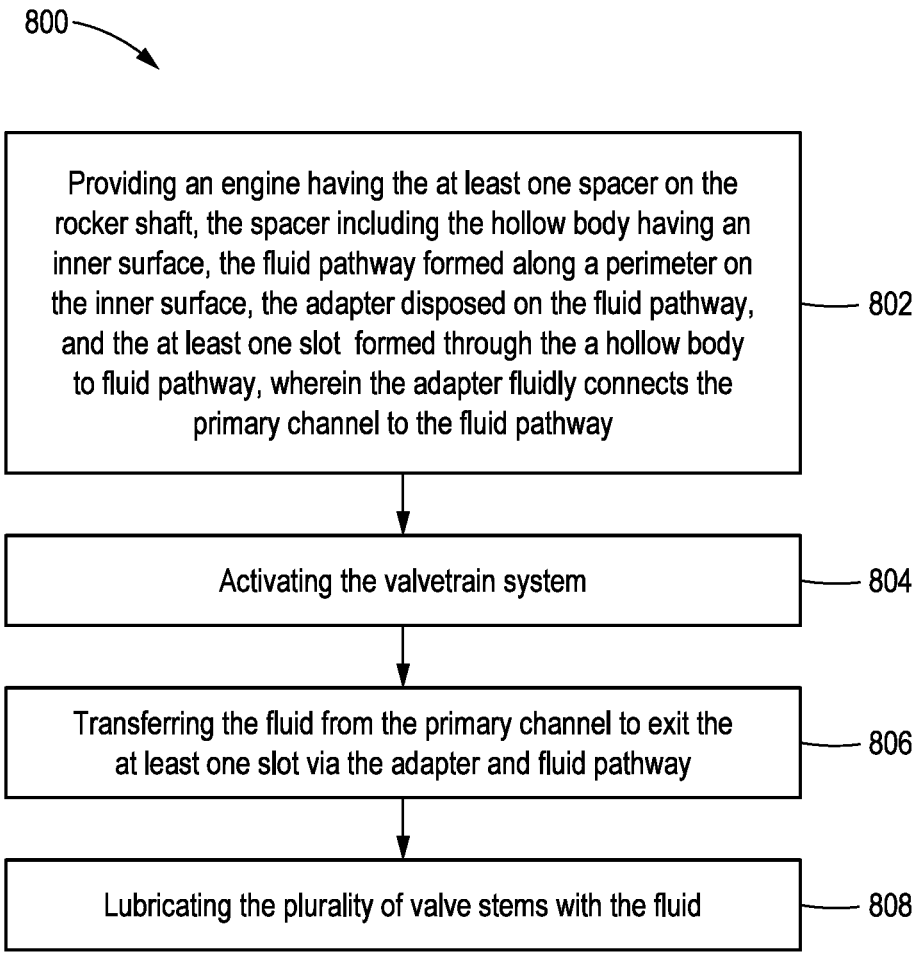
FIG. 10 is a flow chart of a method of lubricating a valve stem in an engine, according to one embodiment of the disclosure.

Now referring to FIG. 10, a flow chart of a method 800 of lubricating a valve stem in a valvetrain system 100 is illustrated, according to one embodiment of the disclosure. In a step 802, the method 800 begins by first providing an engine having the at least one spacer 108 on the rocker shaft 104, the at least one spacer 108 including the hollow body 400 having an inner surface 401, the fluid pathway 404 formed along a perimeter on the inner surface 401, the adapter 304 disposed on the fluid pathway 404, and the at least one slot 200 formed through the hollow body 400 on the fluid pathway 404, wherein the adapter 304 fluidly connects the primary fluid channel 300 to the fluid pathway 404.

In a step 804, the valvetrain system 100 is activated. The valvetrain system 100 may be activated at the activation of a combustion engine, as generally known in the arts. In a step 806, a fluid is transferred from the primary fluid channel 300 to exit the at least one slot 200 via the adapter 304 and fluid pathway 404. In a step 808, the fluid lubricates the plurality of valve stems 102. The fluid lubricates the stem seal 602 untimely falling or dripping into the lubrication area 606 which provides lubrication to improve heat dissipation and avoid dry run environments. The improved heat dissipation avoids dry run environments and extends the life of the stem seal 602 and the valve guide 600 as the plurality of valve stems 102 continue reciprocal motions.

The at least one spacer 108 may be further provided with the second slot 204 and the fastener 202 fastened through the hollow body 400 which supports restricting angular movement of the at least one spacer 108 during operation of the valvetrain system 100 with the combustion box 110.

From the foregoing, it can be seen that the technology disclosed herein has industrial applicability in a variety of settings such as, but not limited to, siphoning fluid from a main supply channel for secondary lubrication of engine components.

What is claimed is:

1. A spacer for an engine, the spacer comprising:
- a hollow body having an inner surface;
- a pathway formed along a perimeter on the inner surface;
- an adapter disposed on the pathway;
- a first slot formed through the hollow body on the pathway; and
- a second slot provided on the hollow body, and a fastener provided extending through the second slot.

2. The spacer of claim 1, further comprising the slot is provided at an angle at the inner surface.

3. The spacer of claim 1, wherein the first slot is 1 mm in diameter.

4. The spacer of claim 1, wherein the adapter includes an adapter flow channel.

5. The spacer of claim 1, wherein the hollow body is an elongated cylindrical or rectangular body.

6. An engine comprising:
- a plurality of valve stems;
- a rocker shaft having a primary fluid channel;
- a plurality of rocker arms rotatably fixed on the rocker shaft and coupled to the plurality of valve stems;
- a plurality of spacers disposed on the rocker shaft between each rocker arms, each spacer having:
  - a hollow body having an inner surface;
  - a pathway formed along a perimeter on the inner surface;
  - an adapter disposed on the pathway and configured to fluidly connect the primary fluid channel and the pathway;
  - a first slot formed through the hollow body along the pathway, and
  - a second slot provided on the hollow body, and a fastener provided in the second slot through the hollow body.

7. The engine of claim 6, wherein each of the plurality of valve stems includes a valve spring, a stem seal, a valve spring retainer, and a stem guide.

8. The engine of claim 6, the adapter has an elongated hollow body forming an adapter fluid channel.

9. The engine of claim 8, the rocker shaft includes at least one secondary fluid channel fluidly connected from the primary fluid channel to the exterior of the rocker shaft, the at least one secondary fluid channel is configured to connect to the adapter and the adapter fluid channel.

10. The engine of claim 8, the rocker shaft includes a plurality of exit flow channels fluidly connecting the primary fluid channel to the pathway and the slot of each of the plurality of spacers via the adapter fluid channel of the adapter.

11. The engine of claim 9, wherein the rocker shaft includes a ball bearing and oil in the primary fluid channel.

12. The engine of claim 8, is coupled to a combustion box that is one of a gas engine or a diesel engine.

13. The engine of claim 8, further comprising oil in the primary fluid channel.

14. The engine of claim 13, the first slot is provided at an angle having a diameter of at least 1 mm.

15. The engine of claim 6, wherein the hollow body is an elongated cylindrical or rectangular body.

16. The engine of claim 6, wherein each of the plurality of spacers includes an adapter channel configured for installing the adapter on the pathway.

* * * * *